US011608602B2

(12) United States Patent
Knief

(10) Patent No.: US 11,608,602 B2
(45) Date of Patent: Mar. 21, 2023

(54) SUPPORT SYSTEM FOR CONSTRUCTING A PRIVACY AND NOISE PROTECTION BARRIER

(71) Applicant: GEOSYSTEM GBK GMBH, Berlin (DE)

(72) Inventor: Henning Knief, Berlin (DE)

(73) Assignee: GEOSYSTEM GBK GMBH, Berlin (DE)

( * ) Notice: Subject to any disclaimer, the term of this patent is extended or adjusted under 35 U.S.C. 154(b) by 248 days.

(21) Appl. No.: 16/810,371

(22) Filed: Mar. 5, 2020

(65) Prior Publication Data

US 2020/0283973 A1 Sep. 10, 2020

(30) Foreign Application Priority Data

Mar. 6, 2019 (DE) ..... 10 2019 105 647.0

(51) Int. Cl.
*E01F 8/02* (2006.01)
*G10K 11/16* (2006.01)

(52) U.S. Cl.
CPC ..... *E01F 8/025* (2013.01); *G10K 11/16* (2013.01)

(58) Field of Classification Search
CPC ..... E01F 8/025; E01F 8/021; E01F 8/024; E04H 17/05; A01G 9/025; E02D 29/028; G10K 11/16
See application file for complete search history.

(56) References Cited

U.S. PATENT DOCUMENTS 1,689,610 A * 10/1928 Winter ..... E04H 17/12 256/48
4,294,430 A * 10/1981 de Jager ..... E04H 17/12 256/48
4,664,358 A * 5/1987 Clark ..... E01F 8/024 256/19
4,805,734 A * 2/1989 Mast ..... E01F 8/021 181/284
8,056,602 B1 * 11/2011 Green ..... E06B 9/52 160/395
9,057,168 B1 * 6/2015 Dugan, Jr. ..... E02B 7/20
2005/0279573 A1 * 12/2005 Ferraiolo ..... E01F 8/021 181/210
2008/0028716 A1 * 2/2008 Cvek ..... A47C 31/023 52/660
2010/0186642 A1 * 7/2010 Christman ..... E01F 8/025 109/79
2010/0221565 A1 * 9/2010 Skeeter ..... E01F 8/025 428/542.2
2015/0204039 A1 * 7/2015 Scott ..... E02B 3/04 405/114
2015/0299969 A1 * 10/2015 James ..... E04H 17/12 256/65.02
2016/0298387 A1 * 10/2016 Green ..... E06B 3/721

* cited by examiner

*Primary Examiner* — Benjamin F Fiorello
(74) *Attorney, Agent, or Firm* — Henry M. Feiereisen LLC

(57) ABSTRACT

A support system for a basket filled with a filler material for creating a privacy or noise protection barrier includes first support elements arranged in side-by-side spaced-apart relationship, second support elements arranged in opposition to the first support elements, and horizontal cross ties interconnecting the first and second support elements on their insides at a distance from one another. Mesh mats are further provided to interconnect the first and second support elements in a longitudinal direction of the support system on their outsides.

10 Claims, 4 Drawing Sheets

SUPPORT SYSTEM FOR CONSTRUCTING A PRIVACY AND NOISE PROTECTION BARRIER

CROSS-REFERENCES TO RELATED APPLICATIONS

This application claims the priority of German Patent Application, Serial No. 10 2019 105 647.0, filed Mar. 6, 2019, pursuant to 35 U.S.C. 119(x) (d), the disclosure of which is incorporated herein by reference in its entirety as if fully set forth herein.

BACKGROUND OF THE INVENTION

The present invention relates to a support system for constructing a privacy and/or noise protection barrier in the form of a basket that can be filled with filler material.

The following discussion of related art is provided to assist the reader in understanding the advantages of the invention, and is not to be construed as an admission that this related art is prior art to this invention.

Noise protection barriers and noise protection walls are generally used to protect against noise emanating from linear or planar sound sources, e.g. roads, railways, factories and the like, thereby ensuring that the noise generated is attenuated to legally specified limits at the buildings being protected, such as residential buildings, hospitals, schools, etc.

Noise protection barriers are manufactured in a variety of materials and shapes. Noise absorbing materials are advantageous since they reduce reflected, penetrating noise particularly well. These are especially porous materials, such as plastic. The materials need to be extremely durable and resistant to weathering. For applications in the railway infrastructure, it must also be taken into account that large differences in pressure are created by passing high-speed trains. Accordingly, the noise protection barriers should offer a robust and stable substructure.

The various shapes and construction methods are selected primarily for aesthetic reasons. Particular curvatures or special top edge shapes can significantly increase efficiency. This involves employing various construction methods and materials. For example, concrete walls are used because of their longevity. Metals such as steel and aluminium are also frequently used. Wood is $CO_2$ neutral and fits relatively well into a landscape, and a long life span can be expected when using modern wood preservatives.

Glass is used primarily for aesthetic reasons. Windows in the wall are intended to combat the monotony of driving for motorists. However, this increases the probability of bird strikes. For this purpose, markings such as white stripes are applied to the glass or nets are placed in front of the glass to allow birds to see it.

Also so-called gabions are becoming increasingly popular in noise protection applications. Plastics or porous materials are also frequently used because of their excellent sound-dampening properties.

Noise protection walls can be backfilled directly with excavated material during road construction and vegetated to guarantee easy integration into the landscape. However, their effectiveness (sound level reduction to height) is usually less than with normal walls and the space required is relatively sizeable.

Although all of these noise barrier structures have proven useful to some degree, they are still relatively expensive to purchase and to manufacture. Furthermore, extensive preparatory and/or ancillary work is often necessary for their construction and completion, which in turn involves increased use of materials and additional manpower and, therefore, financial expenditure.

It would therefore be desirable and advantageous to provide an improved support system for a privacy and noise protection barrier to obviate prior art shortcomings and to enable rapid construction in a material-friendly manner and at reduced costs.

SUMMARY OF THE INVENTION

According to one aspect of the present invention, a support system for a basket filled with a filler material for creating a privacy or noise protection barrier includes first support elements arranged in side-by-side spaced-apart relationship, second support elements arranged in opposition to the first support elements, horizontal cross ties interconnecting the first and second support elements on their insides at a distance from one another, and mesh mats configured to interconnect the first and second support elements in a longitudinal direction of the support system on their outsides.

According to another advantageous feature of the present invention, the mesh mats include horizontal mesh rods, with the first and second support elements having recesses to formfittingly suspend the horizontal mesh rods therein.

A support system in accordance with the present invention thus provides for the presence of a multitude of recesses to accommodate the mesh mats on the exterior-facing outer sides of the installed first support elements and the second support elements. The mesh mats can be formfittingly suspended in these recesses along with their horizontal mesh rods. The mesh mats thus form a flat, basket-like enclosure that can be filled with material. The mesh mats are connected to the support elements in such a way that they do not, or only slightly, bulge outwards when filling is placed in the basket formed in this manner. The suspended mesh mats form an essentially formfitting surface.

According to another advantageous feature of the present invention, the recesses exhibit an opening which faces outwards in a longitudinal direction when the first and second support elements are installed and which continues in a transverse direction of the first and second support elements before reverting back to the longitudinal direction downwards as a slot. The inner width of the opening and the slot substantially corresponds to a diameter of the mesh rods.

According to another advantageous feature of the present invention, each recess can have an undercut configured to formfittingly clamp the horizontal mesh rods when the horizontal mesh rods are inserted in the recesses. The undercuts can hereby be configured to ensure a correct alignment of the mesh rods of the mesh mats.

According to another advantageous feature of the present invention, the recesses can have a G-shaped configuration and include an undercut configured to secure the horizontal mesh rods of the mesh mats against vertical displacement when the horizontal mesh rods are inserted in the recesses in the working or installation position.

According to another advantageous feature of the present invention, the recesses can be configured to allow at least two mesh rods of two mesh mats to be inserted end-to-end into the undercuts substantially flush with the respective free end of the mesh rods and two mesh mats to be locked in the recesses with the aid of the mesh rods. For this purpose, the recess has a certain width, which serves as a support surface for the mesh rods.

These support surfaces can be specifically created using build-up welding materials at the appropriate position of the recesses on the transverse surfaces of the support elements. The support surface extends the recess only indirectly, but an additional supporting structure is formed in its transverse direction which absorbs tensile and compressive forces of the inserted mesh mats and transmits them distributed over a wide surface area into the respective support element. These measures effectively prevent the presence of specific pressure peaks in the material, which in turn enhances the service life of the support system.

To save time and costs, a support system can be prefabricated prior to final installation. According to another advantageous feature of the present invention, the recesses for holding the horizontal mesh rods of the mesh mats may either be punched using a cutting template or cut out with the aid of a laser cutting machine according to static requirements of the support system, while depending on the actual installation site and the type of material filling. Distances and number of recesses in the support elements should hereby be taken into account.

According to another advantageous feature of the present invention, each of the recesses has an opening defined by a width, wherein the width of the opening and a width of the undercut in the recess can correspond to a diameter of the horizontal mesh rods of the mesh mats. Thus, there is no need for reworking at an installation site.

Wire mats or double bar mats can be used as the mesh mats. The mesh mats can be spot-welded and coated with an anti-corrosion agent, for example by hot-dipping or immersion galvanising them, depending on the installation site and ambient conditions. Plastic coatings are also conceivable as elastic polymer coatings.

The actual wire thickness depends on an expected load once the support system has been assembled. High quality structural steel grades are intended as the correct material for the mesh mats.

The distances between the recesses on the support elements depend on the mesh sizes of the mesh mats or vice versa.

The mesh mats or their mesh sizes and the recesses correspond to each other. Thus, the mesh rods can be suspended in the recesses of the support elements without any adjustments and/or waste.

According to another advantageous feature of the present invention, the support system can have a modular configuration and can be prefabricated according to an actual situation at an installation site.

A module includes the first and second support elements, cross ties for connecting the support elements, and the mesh mats, which are inserted into the prefabricated recesses. Due to its modular design, the support system can be extended as required and be flexibly adapted to the local conditions at the installation site.

The first and second support elements can be interconnected via a number of horizontal cross ties. At least two first and second support elements can form a sub-module as a smallest prefabricated unit that can be interconnected. Two sub-modules form a whole module. Depending on requirements and transport capabilities, a complete module can also be delivered prefabricated to the installation site and installed there. A whole module comprised of two sub-modules in turn forms a fillable basket.

According to another advantageous feature of the present invention, the first and second support elements and/or the horizontal cross ties can be made of galvanized wide flat steel.

Depending on the installation site, other surface coatings are also conceivable. Elastic protective coatings based on plastics and/or bitumen can be highly suitable for protecting the support system from mechanical or chemical damage.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
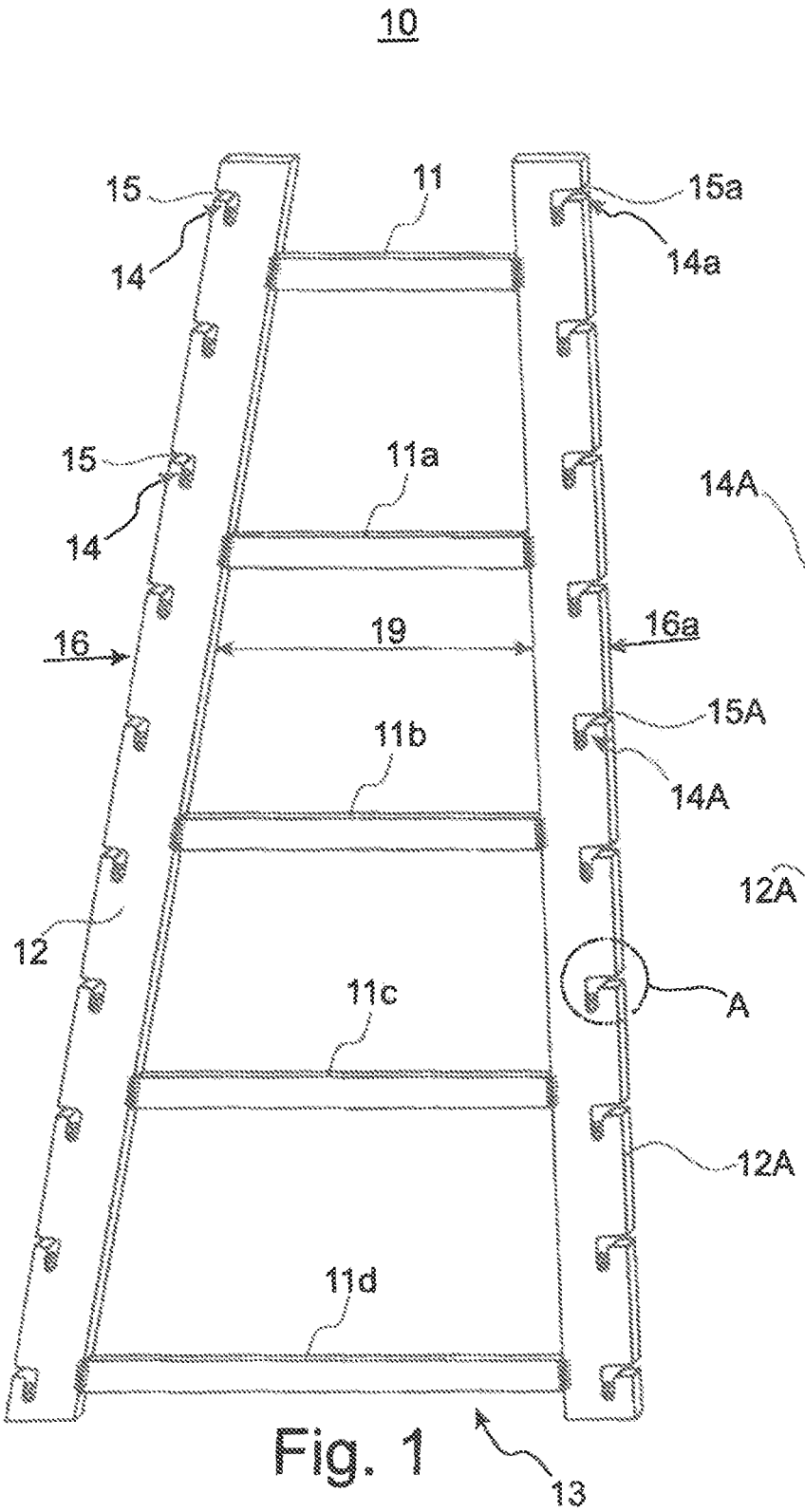
FIG. 1 is a schematic side view of a support system according to the present invention, depicting by way of example two support elements interconnected by cross ties and having recesses to accommodate mesh mats.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic side view of a support system according to the present invention, generally designated by reference numeral 10. The support system 10 includes first support elements 12 and second support elements 12*a* in spaced-apart relationship, and horizontal cross ties 11, 11*a*, 11*b*, 11*c*, 11*d* to interconnect the first and second support elements 12, 12*a*. In this smallest embodiment, the support elements 12 and 12*a* and the cross ties 11, 11*a*, 11*b*, 11*e*, 11*d* form a sub-module 13. Two sub-modules 13 form a whole module. It is intended that sub-module 13 will be prefabricated and only needs to be installed on site.

Recesses 14 and 14*a* are formed in the support elements 12 and 12*a*, respectively. For the sake of clarity, only two reference signs are assigned, wherein identical recesses 14 and 14*a* correspond to the same reference sign. The recesses 14 and 14*a* exhibit openings 15 and 15*a* which open toward the corresponding outer sides 16 and 16*a* when the support elements 12, 12*a* are installed.

Figure 2:
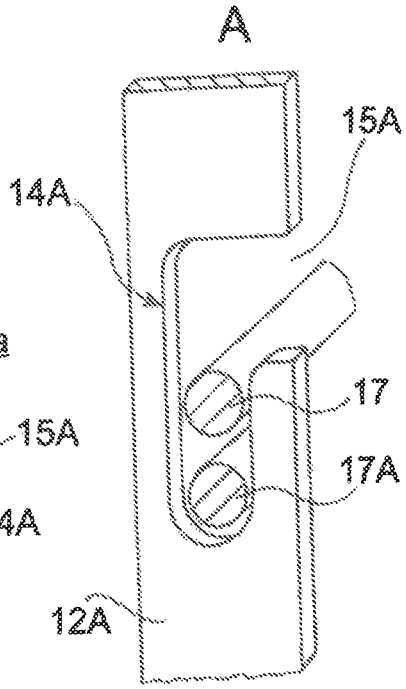
FIG. 2 is an enlarged detailed view of the area encircled in FIG. 1 and marked "A", depicting mesh rods of the mesh mats inserted in the recesses.
Figure 6:
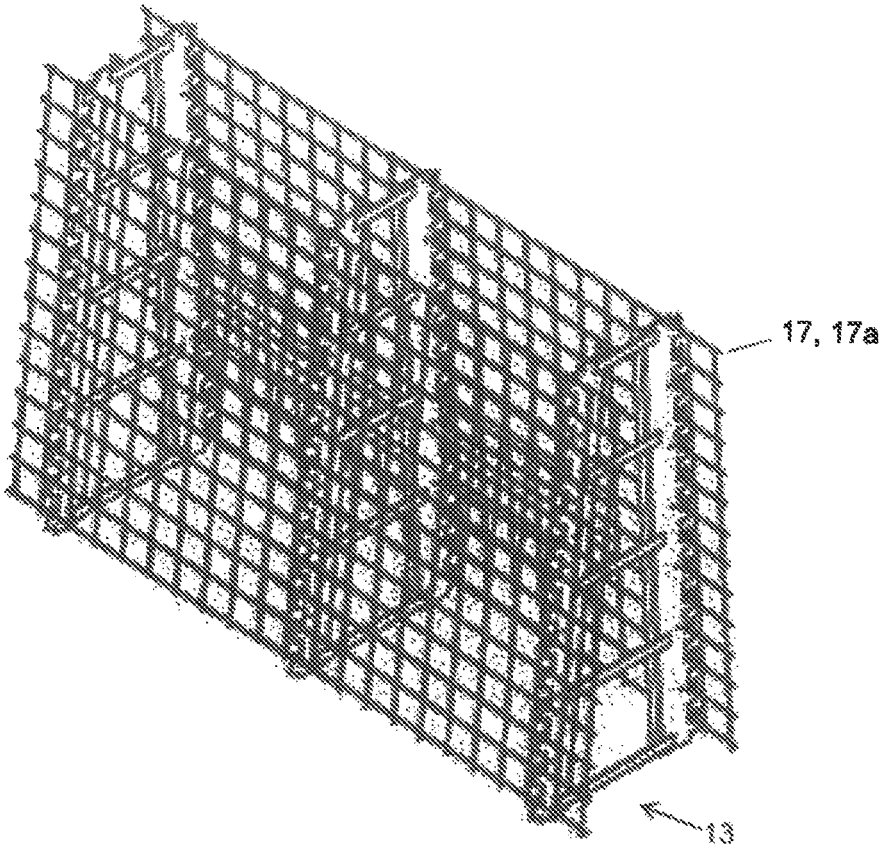
FIG. 6 shows the mesh rods of the mesh mats.

As shown in FIG. 2, cross struts, hereinafter referred to as mesh rods 17, 17*a* can be inserted via the openings 15, 15*a* on the outer sides 16, 16*a*. The mesh rods 17, 17*a* are parts of the mesh mats 21 (FIG. 6) which form a wire or lattice work from interconnected cross and longitudinal ties.

Figure 3:
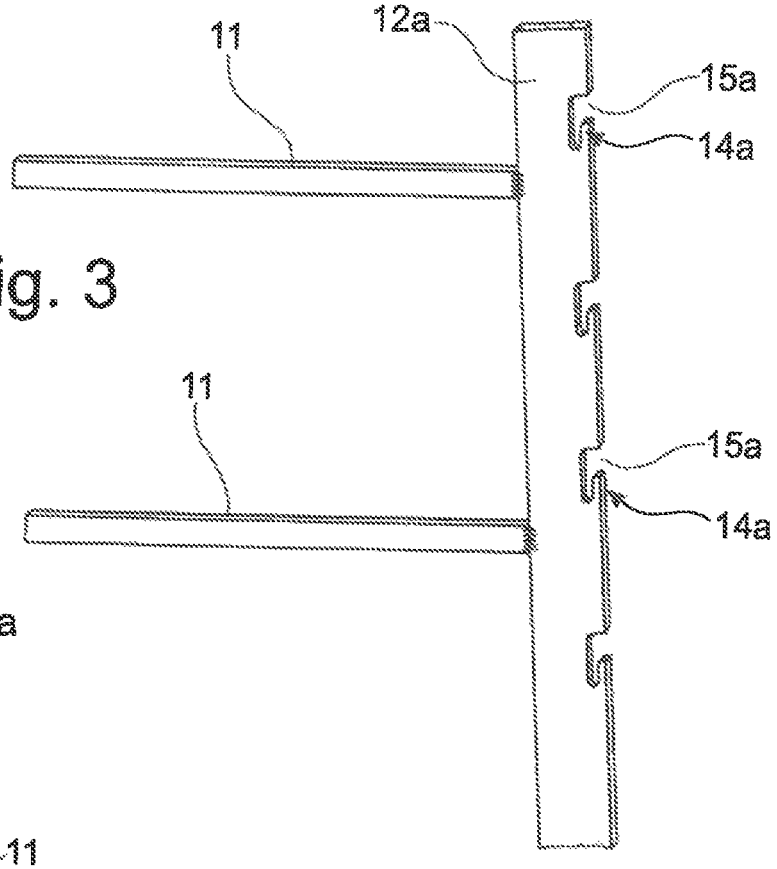
FIG. 3 is a schematic illustration of a possible connection of cross ties and support elements.
Figure 4:
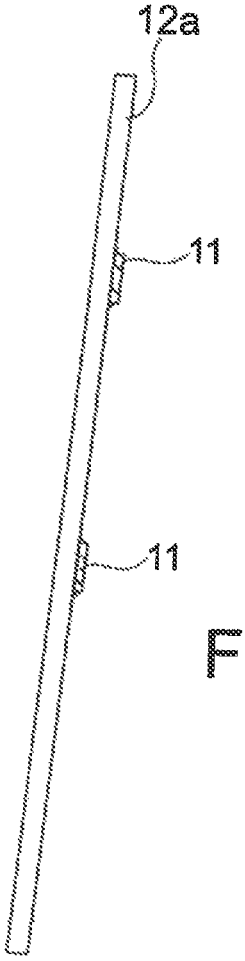
FIG. 4 is a plan view of the connection between the support element and cross tie.

FIGS. 3 and 4 show another embodiment of connecting the cross ties 11 to 11*d* to the support elements 12, 12*a*. In this embodiment, a screw connection 18 is provided on the inner side 20 of the support elements 12 or 12*a*.

Figure 5:
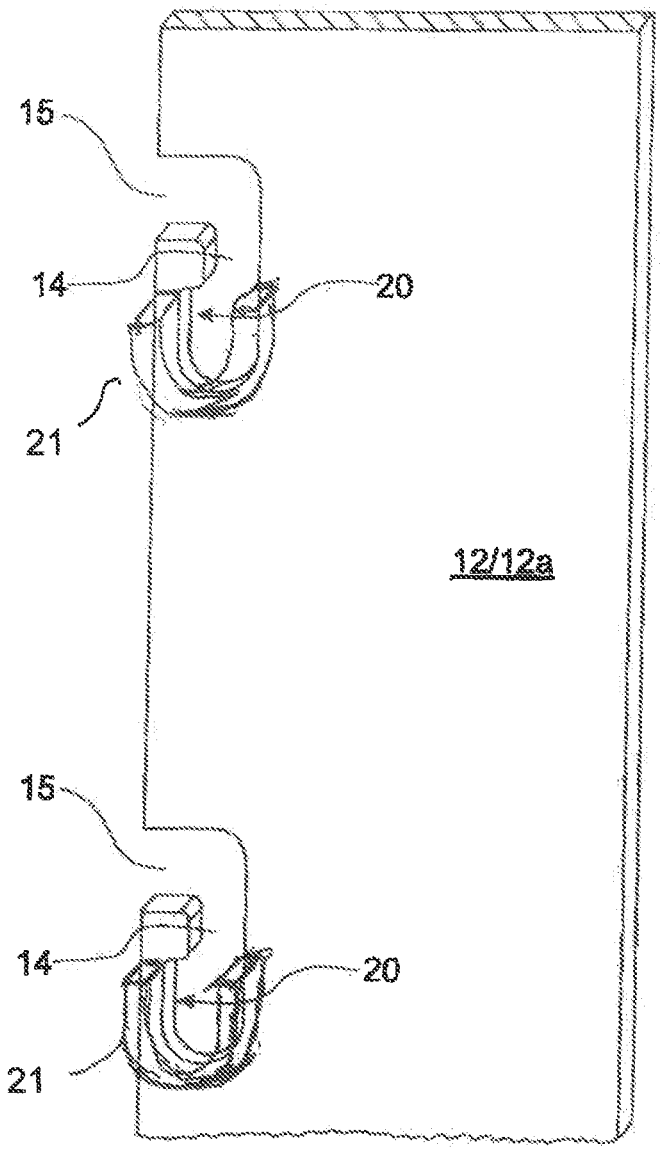
FIG. 5 is a detailed view of a variation of recesses with a G-shape and undercuts for receiving mesh rods of mesh mats.

FIG. 5 shows another variant of recesses 14, 14*a* which have a G-shaped configuration in the support elements 12, 12*a*. In this embodiment, the recesses 14, 14*a* have an undercut 20 behind which the mesh rods 17 and 17*a* of the mesh mats can be suspended.

The mesh mats or mesh rods 17, 17*a* suspended in the recesses 14, 14*a* can be additionally clamped and held by means of wedges or clamps with the support elements 12, 12*a*. The clamps or wedges (not shown) can be configured to seal the openings 15, 15*a* of the recesses 14, 14*a*.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A support system for a basket filled with a filler material for creating a privacy or noise protection barrier, said support system comprising:

first support elements arranged in side-by-side spaced-apart relationship;

second support elements arranged in opposition to the first support elements;

horizontal cross ties interconnecting the first and second support elements on their insides at a distance from one another;

said first and second support elements having recesses with openings that face outwardly in an installation position, mesh rods of mesh mats, said rods insertable in the recesses in a longitudinal direction of the support system, with the mesh rods of the mesh mats being spaced apart commensurate with distances between the recesses of the first and second support elements, the recesses having undercuts that formfittingly clamp the horizontal mesh rods of the mesh mats when the horizontal mesh rods are inserted in the recesses, the recesses further having associated supports forming an additional supporting structure in a transverse direction, which absorbs tensile and compressive forces of the inserted mesh mats and transmits them distributed over a wide surface area into the respective support element.

2. The support system of claim 1, wherein the recesses have a G-shaped configuration and include an undercut configured to secure the horizontal mesh rods of the mesh mats against vertical displacement when the horizontal mesh rods are inserted in the recesses.

3. The support system of claim 2, wherein the recess receives at least two of the horizontal mesh rods above one another in a working position of the support system.

4. The support system of claim 3, wherein at least two mesh rods of two of the mesh mats are insertable end-to-end into the recesses such that the at least two mesh rods are aligned in the undercuts.

5. The support system of claim 1, wherein the recesses receiving the horizontal mesh rods are formed through a punching process using a cutting template or a cutting process using a laser cutting machine.

6. The support system of claim 1, wherein each of the recesses has an opening defined by a width, with the width of the opening and a width of the undercut in the recess corresponding to a diameter of the horizontal mesh rods of the mesh mats.

7. The support system of claim 1, wherein the support system has a modular configuration and is prefabricated.

8. The support system of claim 1, wherein the first and second support elements and the horizontal cross ties are detachably connectable.

9. The support system of claim 1, wherein at least two of the first support elements, at least two of the second support elements, and a number of horizontal cross ties form a sub-module, wherein two of said sub-module arranged in parallel side-by-side relationship with two times two of the first and second support elements form a whole module forming a fillable basket.

10. The support system of claim 1, wherein the first and second support elements or the horizontal cross ties, or both, are made of galvanized wide flat steel.

* * * * *